US006255606B1

(12) United States Patent
Thielman

(10) Patent No.: US 6,255,606 B1
(45) **Date of Patent: *Jul. 3, 2001**

(54) ELECTRIC-SWITCH TOGGLE INHIBITOR

(76) Inventor: Gerhard W. Thielman, 1744 NE. 102nd St., Seattle, WA (US) 98125

( * ) Notice: Subject to any disclaimer, the term of this patent is extended or adjusted under 35 U.S.C. 154(b) by 0 days.

This patent is subject to a terminal disclaimer.

(21) Appl. No.: 09/574,403

(22) Filed: May 19, 2000

Related U.S. Application Data

(63) Continuation-in-part of application No. 09/469,568, filed on Dec. 22, 1999, now Pat. No. 6,118,088.

(51) Int. Cl.[7] ..... H01H 9/20
(52) U.S. Cl. ..... 200/43.16; 200/321

(58) Field of Search ..... 200/43.01, 43.11, 200/43.16, 43.19, 43.21, 43.22, 50.11, 318, 321–327

(56) References Cited

U.S. PATENT DOCUMENTS 6,118,088 * 9/2000 Thielman ..... 200/43.16

* cited by examiner

*Primary Examiner*—Michael Friedhofer

(57) ABSTRACT

A switch inhibitor provides an obstacle for the switch-toggle, the obstacle having a switch-obstacle position and a switch-release position. The obstacle may be held to the switch-obstacle position by a spring, which may be overcome by applying force to a release mechanism. The switch inhibitor may be permanently or removably attached to the cover plate for the electric-switch.

20 Claims, 6 Drawing Sheets

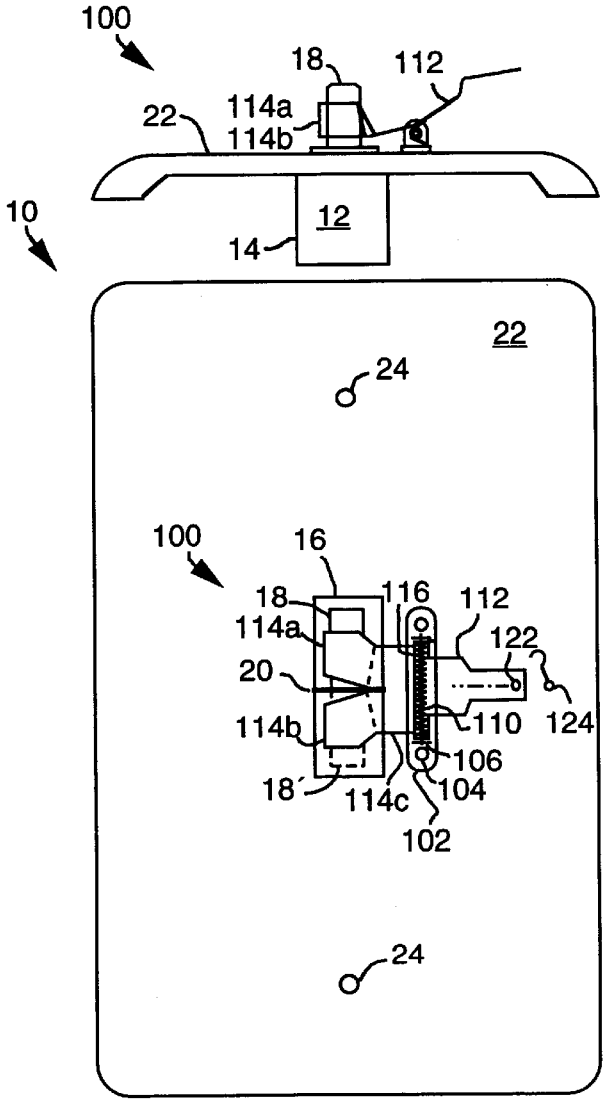
FIG. 1A
FIG. 1C
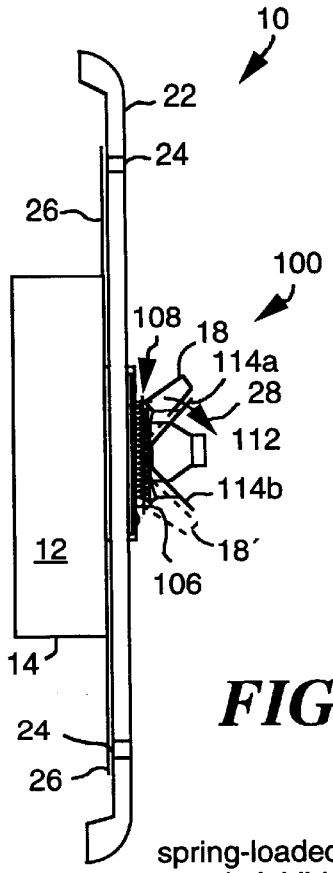
FIG. 1B
spring-loaded leaved toggle inhibitor on a platform riveted to a cover plate FIG. 2A
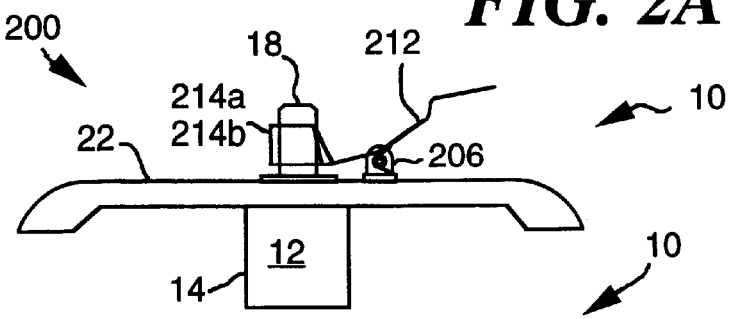
spring-loaded leaved toggle inhibitor on a platform removably retrofitted to a cover plate
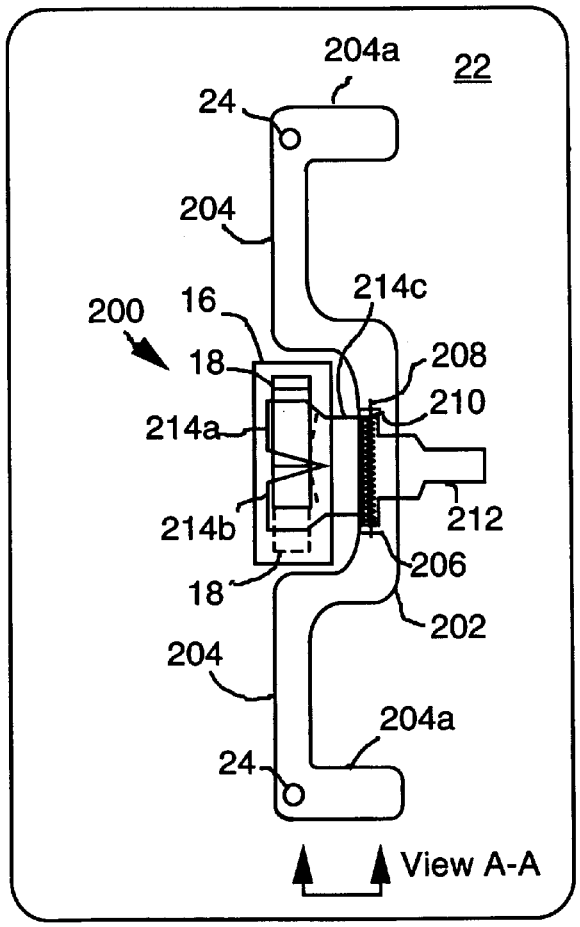
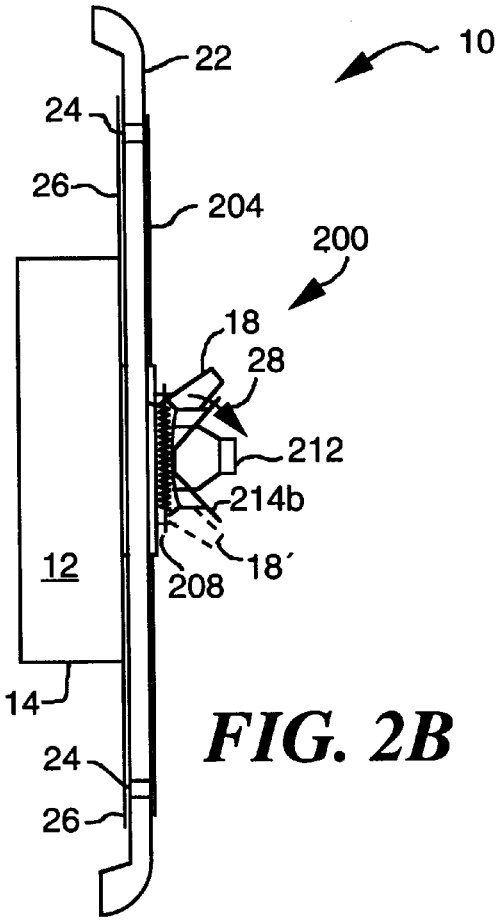
FIG. 2B
FIG. 2C FIG. 2D
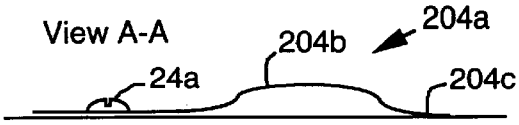
FIG. 2E
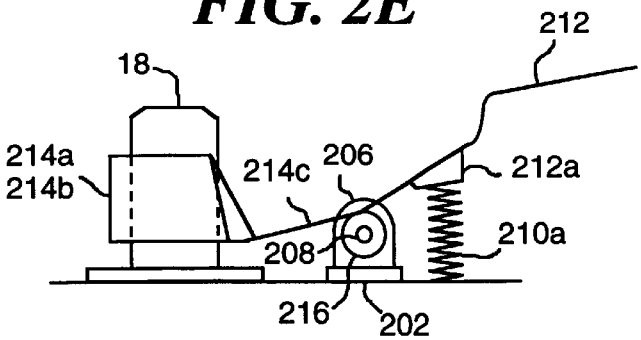
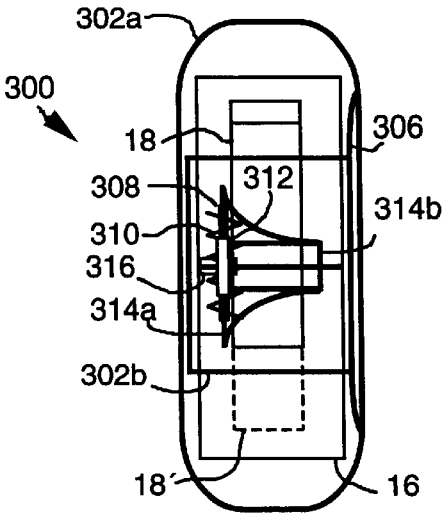
FIG. 3E
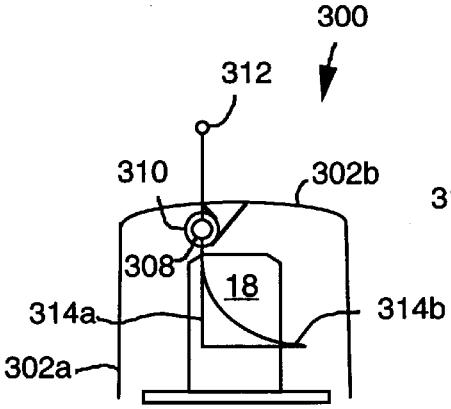
FIG. 3F
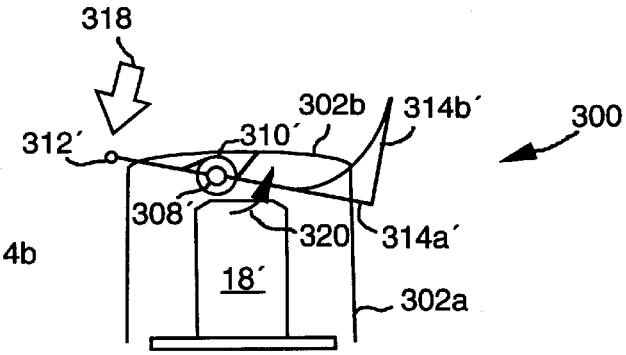
FIG. 3G

ELECTRIC-SWITCH TOGGLE INHIBITOR

CROSS REFERENCE TO RELATED APPLICATION

This application is a Continuation-In-Part of application Ser. No. 09/469,568 filed on Dec. 22, 1999 entitled "Electric Switch Cover", with the name of inventor Gerhard W. Thielman, issued as U.S. Pat. No. 6,118,088 on Sep. 12, 2000.

FIELD OF THE INVENTION

The present invention relates to a dual-positional inhibitor for an electrical control switch. In particular, this invention provides an apparatus to controllably obstruct the toggling of an electric switch-toggle.

BACKGROUND OF THE INVENTION

Wall-mounted electric-switches to control electric lights (or other electrically powered devices) are a common feature in buildings equipped with alternating electric current. Such switches enable a person to freely toggle the projecting lever or switch-toggle in one of two positions relative to its pivot axis, typically closed or "on" when the switch-toggle is above or otherwise to one side of its pivot axis and open or "off" when the switch-toggle is below or otherwise to the opposite side of its pivot axis. The above (upward) and below (downward) positions of the switch-toggle relate to a horizontally oriented pivot axis behind the plane of the cover faceplate that obscures the electrical wiring connecting the switch to the alternating current source. The force required to rotate the switch-toggle along a short arc to its opposite setting is typically designed to be high enough to prevent gravity from pulling the switch-toggle from the upward position to the downward position, but also sufficiently small to enable anyone of even feeble physical exertion to easily manipulate the switch-toggle from the upward position to the downward position or vice versa.

Circumstances arise however, a switch may be set to a semi-permanent position, and the user desires to prevent inadvertent or unauthorized alteration of the switch-toggle position. One common remedy to inhibit switch toggling is applying a strip of adhesive tape covering over the switch as a visible and tactile mechanism to alert someone in visible proximity that the switch setting is not intended to be altered. However, such an artifice may appear unsightly or unprofessional, and cannot be altered without removal and/or replacement of the tape strip. In addition, upon removal of the tape strip unsightly adhesive residue may remain on the cover plate and/or the switch-toggle.

Toggle-switch covers that are hinged for removal of the toggle-obstacle have been employed for instrumentation. However, while considered appropriate for control panels, these may not be suitable for household or commercial use due to the additional clearance volume needed to position the cover from obstruction of the switch-toggle to non-obstruction. Hence a mechanism to provide a more directly utilitarian functionality and be aesthetic would be desirable.

SUMMARY OF THE INVENTION

A switch inhibitor provides an obstacle for the switch-toggle, the obstacle having a switch-obstacle position and a switch-release position. The obstacle may be held to the switch-obstacle position by a spring, which may be overcome by applying force to a release mechanism. The switch inhibitor may be permanently or removably attached to the cover plate for the electric-switch.

OBJECTS AND ADVANTAGES OF THE INVENTION

The electric-switch inhibitor is intended to provide an obvious indication that an electric-switch has been toggled to a fixed position, and the switch-toggle cannot be disturbed without a deliberate effort to override the inhibitor's passive state that holds the switch-toggle in position. A person would thereby have implied notice that permission of that authority controlling the switch setting may be required before tampering with the electric-switch. The electric-switch cover provides a removable obstacle that requires little conscious effort to override, but nonetheless reduces the risk of accidental toggling or unauthorized manipulation.

BRIEF DESCRIPTION OF THE FIGURES

FIG. 1A is a top-cross-sectional view diagram of an electric-switch inhibitor according to a specific embodiment of the present invention.

FIG. 1B is a side-cross-sectional view diagram of an electric-switch inhibitor according to a specific embodiment of the present invention.

FIG. 1C is a front-cross-sectional view diagram of an electric-switch inhibitor according to a specific embodiment of the present invention.

FIG. 2A is a top-cross-sectional view diagram of an electric-switch inhibitor according to a specific embodiment of the present invention.

FIG. 2B is a side-cross-sectional view diagram of an electric-switch inhibitor according to a specific embodiment of the present invention.

FIG. 2C is a front-cross-sectional view diagram of an electric-switch inhibitor according to a specific embodiment of the present invention.

FIG. 2D is a top-cross-sectional view detail diagram of an electric-switch inhibitor attachment to the cover plate according to a specific embodiment of the present invention.

FIG. 2E is a top-cross-sectional view detail diagram of an electric-switch inhibitor according to an alternative embodiment of the present invention.

FIG. 3E is a front-cross-sectional detail view diagram of an electric-switch cover according to a specific embodiment of the present invention.

FIG. 3F is a top-cross-sectional detail view diagram of an electric-switch cover in a passive state according to a specific embodiment of the present invention.

FIG. 3G is a top-cross-sectional detail view diagram of an electric-switch cover in the forced state according to a specific embodiment of the present invention.

DETAILED DESCRIPTION OF THE PREFERRED EMBODIMENTS

Figure 1D:
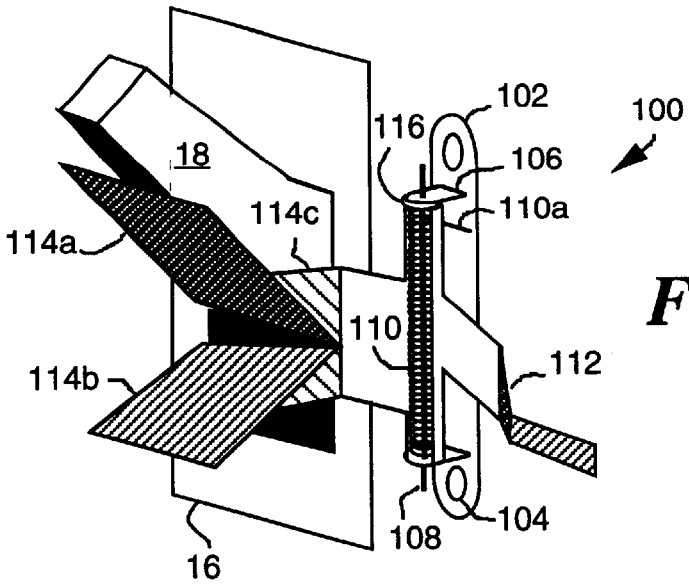
FIG. 1D is an isometric detail view diagram of an electric-switch inhibitor according to a specific embodiment of the present invention.

Those of ordinary skill in the art will realize that the following description of the present invention is illustrative only and not in any way limiting. Other embodiments of the invention will readily suggest themselves to such skilled persons after a perusal of the within disclosure.

The present invention is a device to removably obstruct a change in position of an electric-switch. In one embodiment, the device may be permanently installed over the surface of the faceplate cover in front of the switch-toggle. In an alternate embodiment, the device may be removably attached at the openings in the faceplate cover in which helically threaded fasteners may be inserted for securing the faceplate cover to the electric-switch.

The invention may be described in essence as a device with a platform, a flange, a spring, and a release mechanism. The platform may secure the device to the electric-switch or its faceplate cover. The flange may be designed for removably impeding the switch-toggle, restricting it to a single position when the flange is at rest or in the relaxed or passive state, and not impeding the switch-toggle when the flange is forced. The spring may be connected with the flange to hold the flange while in the passive position. The release mechanism may allow counteraction of the spring's force and thereby enable the flange to be moved to the forced state. The switch-toggle may be repositioned with the flange repositioned in the forced state. For the within disclosure, three embodiments are presented.

Flange Toggle Inhibitor on Riveted Platform

In a first embodiment of the present invention, illustrated in FIGS. 1A, 1B and 1C, an electric-switch with a cover plate assembly 10 is shown, as is recognized by persons of ordinary skill in the art. The electric-switch 12 includes an electrical housing 14, a toggle mount 16, the switch-toggle in an upward position 18, with a downward position 18' shown in dashed lines, and a toggle hinge 20. The electric-switch 12 may be secured to a wall within a junction box.

The faceplate cover 22 or panel obscures and is connected to an electric-switch 12 by means of helical threaded fasteners (not shown) such as bolts through upper and lower fastener apertures 24 on the faceplate cover 22. Each fastener may pass through a switch flange 26 integrated to the electrical housing 14. The coöperation of each fastener through the switch flange 26 secures the faceplate cover 22 to the electric-switch 12, which is held in the electrical junction box by other attachment means.

The switch-toggle in the upward position 18 may be repositioned to the downward position 18' in an angular arc 28 by rotation along the toggle hinge 20. The arc volume that the switch-toggle may occupy includes the space for the switch-toggle in the upward position 18, the corresponding space for the downward position 18', and the arc region swept by the switch-toggle while rotatably traversing between these positions 18 and 18', respectively. Although the invention is depicted for a faceplate cover 22 featuring a single switch, the invention may also be applied to a faceplate cover designed for more than one switch, typically placed side by side along a direction parallel to the switch toggle hinge 20.

Figure 1E:
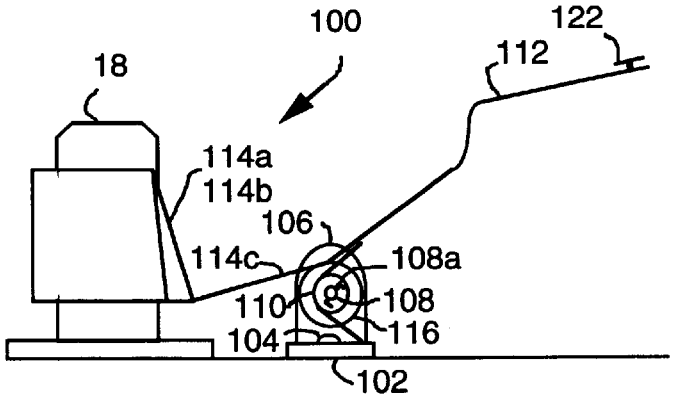
FIG. 1E is a top-cross-sectional detail view diagram of an electric-switch inhibitor in the passive state according to a specific embodiment of the present invention.

The first embodiment inhibitor 100 in the top view in FIGS. 1A and 1E illustrates a platform or mounting plate 102 that may be permanently attached to the faceplate cover 22. From the front view in FIG. 1B, the inhibitor 100 may be seen to be secured in position to one or the other side of the switch 12 by a pair of rivets 104 penetrating through the faceplate cover 22 and fastened thereto. The rivets 104 may be disposed in tandem beyond the ends of the platform 102 in a substantially vertical orientation approximately parallel to the intersecting surface of the faceplate cover 22 and the travel arc of the switch-toggle, as shown in FIGS. 1C and 1G.

A pair of mounts 106 may extend from the platform 102 approximately perpendicular to the surface of the faceplate cover 22 as shown in FIG. 1C and may be positioned between the rivets 104 or other attachment means well known in the art, such as threaded nut and bolt combinations. Alternatively, a platform 102 may be integrated into the faceplate cover 22 as a single piece with mounts 106 molded in place. An isometric view of the inhibitor 100 is shown in FIG. 1D. Each mount 106 may have an aperture through which a shaft 108 may be inserted, extending between and through both mounts 106 as shown in FIGS. 1B and 1C. The shaft 108 may be restricted from removal by a pin 108*a* shown in FIG. 1E or by a notch or other means as is well known in the art. The shaft 108 may be oriented approximately parallel to the faceplate cover 22 and the arc plane of travel for the switch-toggle from the upward position 18 to the downward position 18'.

A spring 110 in the form of a helical coil as shown in isometric detail in FIG. ID may be disposed along the shaft 108 between the pair of mounts 106. A release mechanism, such as a handle 112, may be in contact with the spring 110. The relaxed and forced positions of the handle as 112 and 112' are contrasted in FIGS. 1E and 1F respectively. The handle 112 may be positioned so that in the absence of an external force applied against the handle 112, the spring 110 may maintain the inhibitor 100 in a passive position. The spring 110 may have two ends extending from the helical coil, a first end being in contact with the platform 102 and a second end in contact with the handle 112. If the faceplate cover 22 serves as the structure for the platform 102, the first end may be in contact with the faceplate cover 22 directly. The helical spiral form of the spring 110 may transfer shear force to maintain the relative position between the platform 102 and the handle 112.

The switch-toggle may be maintained in the upward position 18 by an upper flange 114*a,* or in the downward position 18' by a lower flange 114*b.* The physical presence of the upper flange 114*a* may present an obstacle to the movement of the switch-toggle in the upward position 18. Similarly, the lower flange 114*b* may inhibit the movement of the switch-toggle in the downward position 18'. The upper and lower flanges 114*a* and 114*b* may form a wide angle "v" shape as shown in FIG. 1H with the switch-toggle upward and downward positions on either side of the flanges pair. FIG. 1H also shows the rivet 204 penetrating through faceplate cover 22. A gap may physically separate the upper and lower flanges 114*a* and 114*b* as visible in FIG. 1G.

The upper and lower flanges 114*a* and 114*b* may each be rigidly attached to a connecting flange 114*c*. The connecting flange 114*c* may lie in a plane independent of the upper and lower flanges 114*a* and 114*b*, This condition suggests folding or bending interfaces joining the connecting flange 114*c* to the upper and lower flanges 114*a* and 114*b*, A flange assembly made from sheet metal may have these folds produced by stamping, whereas a flange assembly from plastic may form the complete shape by injection molding or similar process well known in the art.

The connecting flange 114*c* may be connected to the shaft 108 by a ring pair 116 (shown in FIGS. 1D and 1E), which in turn may be rigidly connected to the shaft 108 so that the connecting flange 114*c* and shaft 108 may move coöperatively. The handle 112 may also be connected or attached to the shaft 108 by the ring pair 116 or similar instrument. To release the upper and lower flanges 114*a'* and 114*b'* from the switch-toggle, a force 118 may be applied to the handle 112' in a direction approximately towards the faceplate cover 22, causing the handle 112' to pivot in an arc 120 (shown clockwise in FIG. 1F). The spring 110' may be placed in torsion from the combination of forces between the handle 112' and the platform 102.

Figure 1F:
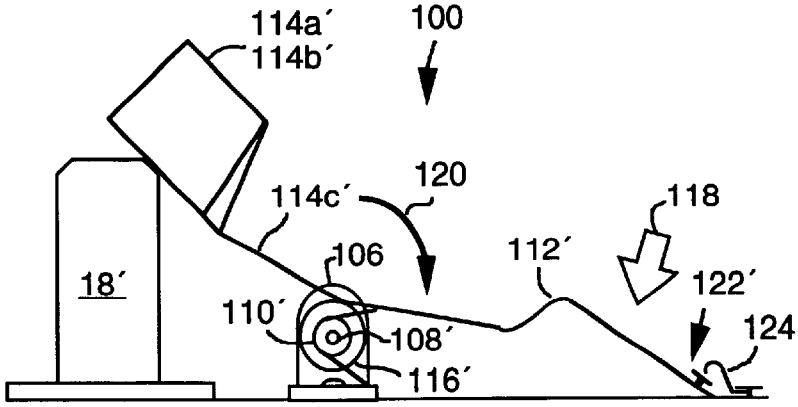
FIG. 1F is a top-cross-sectional detail view diagram of an electric-switch inhibitor in the forced state according to a specific embodiment of the present invention.
Figure 1G:
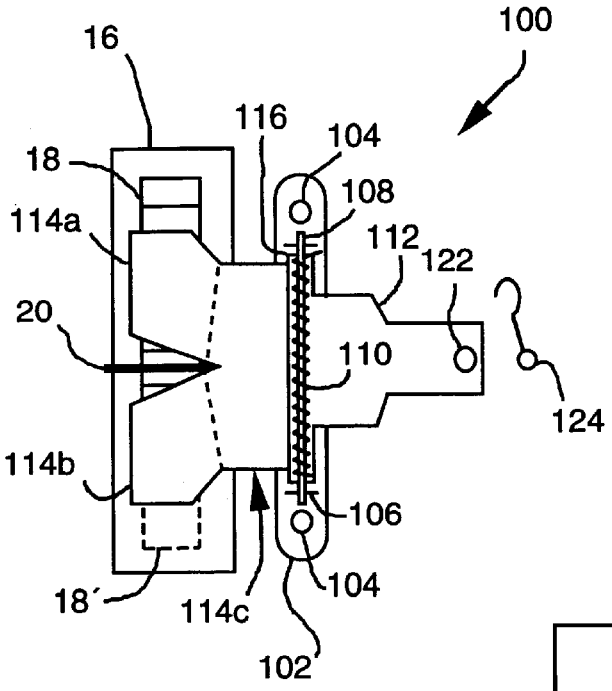
FIG. 1G is a front-cross-sectional detail view diagram of an electric-switch inhibitor according to a specific embodiment of the present invention.
Figure 1H:
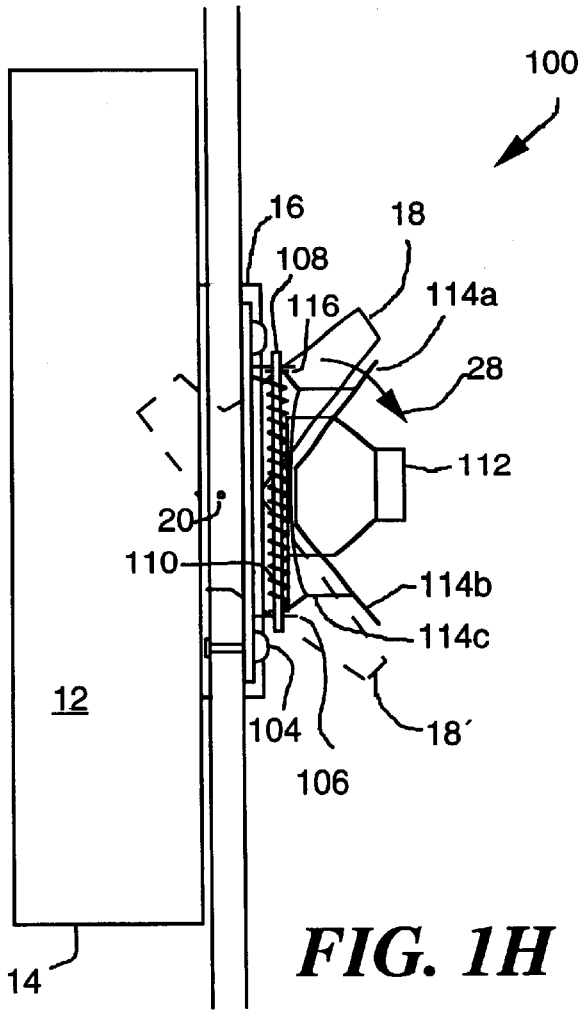
FIG. 1H is a side-cross-sectional detail view diagram of an electric-switch inhibitor according to a specific embodiment of the present invention.

The handle 112' may be connected to the shaft 108 by a ring pair 116' shown in FIG. 1F along with the connecting flange 114*c'*, or the handle 112' and connecting flange 114' may coöperate together in response to rotation of the shaft 108'. Thus, when a force 118 overcomes the torsional force of the spring 110' and pivots the handle 112' about the axis of the shaft 108', the connecting flange 114*c'* may also be pivoted about that same axis. Consequently, the upper and lower flanges 114*a'* and 114*b'* may be lifted away from the switch toggle enabling an arc travel from the upward position 18 to the downward position 18' or vice versa. To maintain the handle 112' in the forced position, a button 122 may be connected towards the end farthest from the shaft 108' and a pivoting latch 124 may loop around the button 122 to prevent the spring 110' from returning the handle 112' in the forced position to the handle 112 in the relaxed position. The pivoting latch 124 may be attached to the faceplate cover 22. Depending on the relative angle between the forced handle 112' and the faceplate cover 22, the pivoting latch 124 may bend to conform to the relative angle, as shown in FIG. 1F.

Flange Toggle Inhibitor on Removable Platform

In a second embodiment of the present invention, illustrated in FIGS. 2A, 2B and 2C, an electric-switch with a cover plate assembly 10 is shown with the same features as shown in FIGS. 1A, 1B and 1C. These include the electric-switch 12, electrical housing 14, toggle mount 16, switch-toggle in the upward and downward positions 18 and 18' respectively, toggle hinge 20, faceplate cover 22, fastener apertures 24, switch flange 26, and angular arc 28 through which the switch-toggle may travel. These items need not be discussed further.

The second embodiment inhibitor 200 in the top view in FIG. 2A illustrates a platform 202 that may be removably attached to the faceplate cover 22. From the front view in FIG. 2B, the inhibitor 200 may be seen to be secured by a faceplate bracket 204 through which threaded fasteners may be received through apertures corresponding to the faceplate apertures 24 in faceplate cover 22. FIG. 2D features a detail top view showing fastener 24*a*. The faceplate bracket 204 may include a leaf-spring 204*a* extending approximately perpendicular to the longitudinal direction between the faceplate apertures 24. The leaf-spring 204*a* may include a generally concave-bending shear-bearing portion 204*b* and a surface engaging portion 204*c* to connect with the outer surface of the faceplate cover 22.

A pair of mounts 206 may extend from the platform 202 approximately perpendicular to the surface of the faceplate cover 22 as shown in FIG. 2C and may be positioned to the side of the switch-toggle. Each mount 206 may have an aperture through which a shaft 208 may be inserted, extending between and through both mounts 206 as shown in FIGS. 2B and 2C. The shaft 208 may be oriented approximately parallel to the faceplate cover 22 and the arc plane of travel for the switch-toggle from the upward position 18 to the downward position 18'.

A spring 210 in the form of a helical coil may be disposed along the shaft 208 between the pair of mounts 206. A release mechanism, such as a handle 212 may be in contact with the spring 210. The handle 212 may be positioned so that in the absence of an external force applied against the handle 212, the spring 210 may maintain the inhibitor 200 in a passive position. The spring 210 may have two ends extending from the helical coil, one end being in contact with the mounting platform 202 and the other in contact with the handle 212. The helical spiral form of the spring 210 may transfer shear force to maintain the relative position between the mounting platform 202 and the handle 212. A force applied to the handle 212 translated to the mounting platform 202 may be further borne by leaf-spring 204*a* to alleviate the tendency for the mounting platform 202 to rotate in conjunction with the handle 212.

The switch-toggle may be maintained in the upward position 18 by an upper flange 214*a*, or in the downward position 18' by a lower flange 214*b*. The physical presence of the upper flange 214*a* may inhibit the movement of the switch-toggle in the upward position 18. Similarly, the lower flange 214*b* may inhibit the movement of the switch-toggle in the downward position 18'. The upper and lower flanges 214*a* and 214*b* may form a "v" shape as shown in FIG. 2B with the switch-toggle upward and downward positions on either side of the flanges pair.

The upper and lower flanges 214*a* and 214*b* may each be attached to a connecting flange 214*c*. The connecting flange 214*c* may lie in a plane independent of the upper and lower flanges 214*a* and 214*b*, This condition suggests folding or bending interfaces joining the connecting flange 214*c* to the upper and lower flanges 214*a* and 214*b*, A flange assembly made from sheet metal may have these folds produced by stamping, whereas a flange assembly from plastic may form the complete shape by injection molding or similar process well known in the art.

The connecting flange 214*c* may be connected to the shaft 208 by a ring pair 216, which in turn may be rigidly attached to the shaft 208 so that the connecting flange 214*c* and shaft 208 may move coöperatively. The handle 212 may also be attached to the shaft 208 by the ring pair 216 or similar instrument. To release the upper and lower flanges 214*a* and 214*b* from the switch-toggle, a force may be applied to the handle 212 in a direction approximately towards the faceplate cover 22, causing the handle 212 to pivot in an arc. Consequently, the upper and lower flanges 214*a* and 214*b* may be lifted away from the switch toggle enabling an arc travel from the upward position 18 to the downward position 18' or vice versa.

In an alternate embodiment shown in FIG. 2E, the handle 212 may include a receptacle 212*a* on the underside facing the faceplate cover 22. The receptacle 212*a* may receive a spring 210*a* to maintain the handle 212 in the relaxed position. The spring 210*a* may be oriented approximately perpendicular to the surface of the faceplate cover 22.

Rotating Lever and Jaw Embodiment on a Removable Platform

Figure 3A:
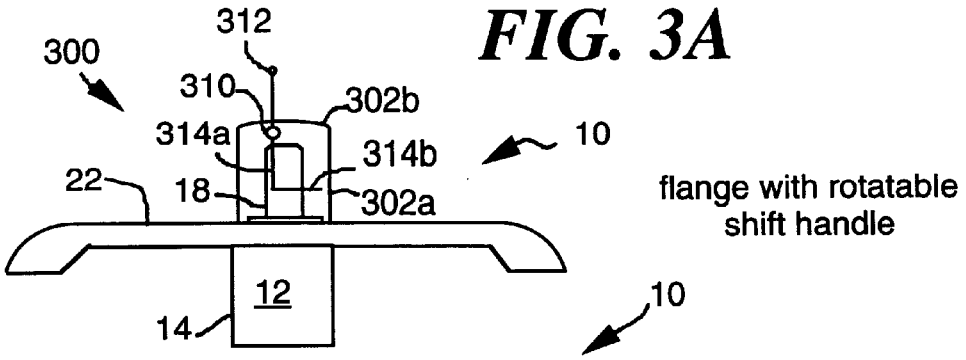
FIG. 3A is a top-cross-sectional view diagram of an electric-switch cover according to a specific embodiment of the present invention.
Figure 3C:
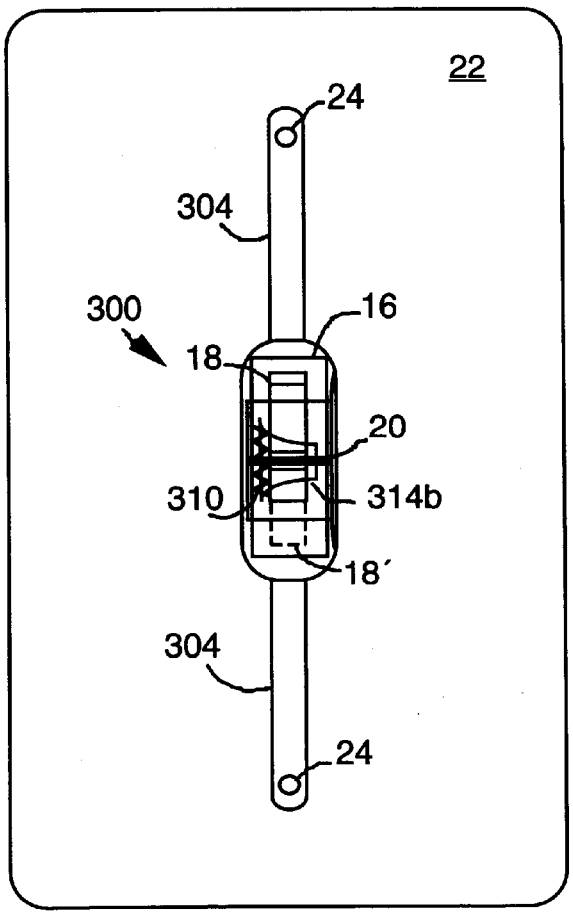
FIG. 3C is a front-cross-sectional view diagram of an electric-switch cover according to a specific embodiment of the present invention.
Figure 3B:
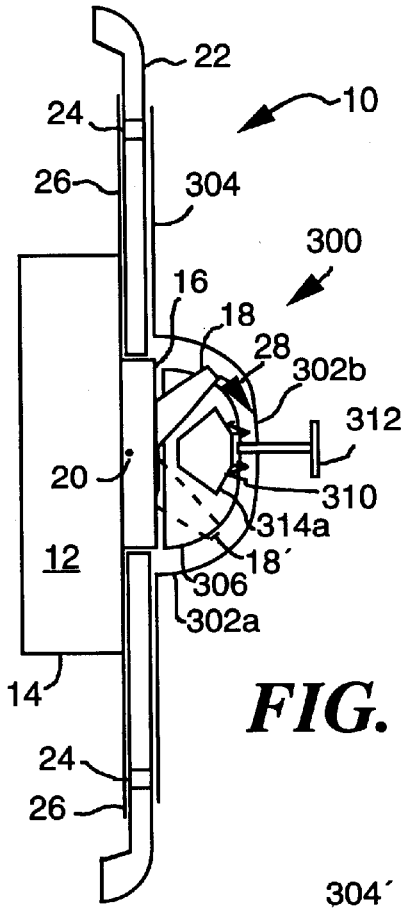
FIG. 3B is a side-cross-sectional view diagram of an electric-switch cover according to a specific embodiment of the present invention.

In a third embodiment of the present invention, illustrated in FIGS. 3A, 3B and 3C, an electric-switch with a cover plate assembly 10 is shown with the same features as shown in FIGS. 1A, 1B and 1C. These include the electric-switch 12, electrical housing 14, toggle mount 16, switch-toggle in the upward and downward positions 18 and 18' respectively, toggle hinge 20, faceplate cover 22, fastener apertures 24, switch flange 26, and angular arc 28 through which the switch-toggle may travel. These items need not be discussed further.

Figure 3D:
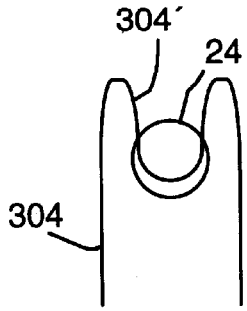
FIG. 3D is a front-cross-sectional detail view diagram of an electric-switch cover faceplate flange according to a fourth embodiment of the present invention.

The third embodiment inhibitor 300 (including a toggle cover) in the top view in FIG. 3A illustrates a cover top and bottom housing 302*a* and a cover front housing 302*b*, which together may be integrated as a single unit for a cover housing. From the front view in FIG. 3B, the inhibitor 300 may be seen to be secured by a faceplate bracket 304 through which threaded fasteners may be received through apertures corresponding to the faceplate apertures 24. Alternatively in FIG. 3D, instead of an aperture in faceplate bracket 304 that may be flexible, fasteners may be slid into a open slot 304' and held by friction after the fasteners are screwed tightly in place against the faceplate cover 22 with faceplate bracket 304 between the fastener head and faceplate cover 22.

A detail front view of the cover 300 in the passive or relaxed position may be examined in FIG. 3E, showing the cover top and bottom housing 302*a*, the cover front housing 302*b*, a cover aperture 306, a shaft 308, a spring 310, a rotating lever 312, the attaching and engaging flanges 314*a* and 314*b* respectively. A slot 316 for the rotating lever 312 to travel within the cover front housing 302*b* is shown in FIGS. 3B and 3E.

Access to reach the switch-toggle in the upward and downward positions 18 and 18' respectively, should be possible from at least one side of the cover top and bottom housing 302*a* such as by a cover aperture 306 shown in FIG. 3E on the right side and FIG. 3C. Alternatively, a cover housing, 302*a* and 302*b*, may provide only a framework to which functioning or attaching components may be connected with access to the switch-toggle sufficiently unrestricted as to obviate the need for a cover aperture 306.

A shaft 308 and a helical spring 310 may be oriented with their major axes parallel to the surface of the faceplate cover 22 and the plane for the travel plane of the switch-toggle. The shaft 308 may pass through the helical spring 310 and be secured at the ends to the cover front housing 302*a*. Extending forward (or outward) from the cover front housing 302*b* on the opposite side as the cover aperture 306 is a rotating lever 312. The helical spring 310 maintains the rotating lever 312 in position forward of the faceplate cover 22 by applying torsional force between the rotating lever 312 and the inner surface of the cover front housing 302*b*. The helical spring 310 preferably exhibits the shape of a spiral coil, although other shapes may be used.

The switch-toggle may be held by an engaging flange 314*b* that inhibits movement of the switch-toggle to a first position shown as upward position 18. An attaching flange 314*a* may be rigidly connected at one end to the engaging flange 314*b* and at the opposite end to the shaft 308. This arrangement allows solid body rotation of the assembly, although other connection criteria are possible without departing from the scope of the invention. The rotating lever 312 and shaft 308 may serve together as the release mechanism of the engaging flange 314*b* allowing the force 318 to overcome the torsion applied by the spring 310. The interaction of these elements is described below.

A detail top view of the cover 300 in the passive or relaxed position may be seen in FIG. 3F, showing the cover top and bottom housing 302*a*, cover front housing 302*b*, the helical spring 310, the shaft 308, the rotating lever 312, the attaching flange 314*a* and the engaging flange 314*b*, FIG. 3G shows a detail top view of the inhibitor 300 in the forced or retracted position. Items featured include both cover housing portions 302*a* and 302*b*, the rotating lever 312' being depressed by force 318 and rotating through angle 320 along the axis of rotation of the shaft 308' and the helical spring 310' being compressed. The attaching and engaging flanges 314*a'* and 314*b'* are shown having been rotated so as to release the obstruction to the switch-toggle.

By pressing a finger against the rotating lever 312' to apply force 318, the helical spring 310' can be compressed, rotating the shaft 308' along an arc of an angle 320 with the attaching flange 314*a'* and the engaging flange 314*b'* attached thereto. By rotating engaging flange 314*b'*, the obstruction inhibiting movement of the switch toggle from its upward position 18 to its downward position 18' or vice versa may be controllably removed.

A finger inserted through the cover aperture 306 enables the switch-toggle to be repositioned from the upward position 18 to the downward position 18' after the engaging flange 314*b'* has been retracted. A retractable locking mechanism might also be included in this design to hold the rotating lever 312' in the pushed position while the switch-toggle is being repositioned. When the rotating lever 312' having been depressed in FIG. 3G, is released to the relaxed position for rotating lever 312, the helical spring 310 restores the elements to the positions shown in FIG. 3F. The engaging flange 314*b* then resumes to impede the movement of the switch-toggle by its presence as a physical obstacle. The inventive characteristics of the device remain independent of lateral symmetry.

While embodiments and applications of the invention have been shown and described, it would be apparent to those of ordinary skill in the art, after a perusal of the within disclosure, that many more modifications than mentioned above are possible without departing from the inventive concepts herein. The invention, therefore, is not to be restricted except in the spirit of the appended claims.

What is claimed is:

1. A switch inhibitor for releasably restricting a switch-toggle, said switch inhibitor attachable to a conventional wall-mounted electrical switch having a cover plate, said switch-toggle rotatably positionable to one of a current-on switch position and a current-off switch position across a switch arc volume in a toggle movement, said switch inhibitor comprising:

a platform secured to the cover plate;

a movable flange for impeding the toggle movement of the switch-toggle, wherein said movable flange can travel between a passive position and a forced position;

a spring for holding said movable flange in said passive position, said spring connected with said platform and with said movable flange so that said spring and said movable flange can move coöperatively while said platform is stationary; and a release for controllably overcoming said spring, wherein said movable flange is moved to said forced position if a force is applied to said release allowing the switch-toggle to be positioned from a first position to a second position, said first position and second position being one of either the current-on position or the current-off position, wherein said first position differs from said second position.

2. A switch inhibitor according to claim 1 wherein said platform further comprises:

a mounting plate; and a plurality of fasteners connecting said mounting plate to the cover plate.

3. A switch inhibitor according to claim 2 wherein said plurality of fasteners are rivets.

4. A switch inhibitor according to claim 2 wherein said mounting plate further comprises:

a first mount extending outward from the cover plate;

a second mount extending outward from the cover plate; and a shaft disposed between said first mount and said second mount.

5. A switch inhibitor according to claim 4 wherein said spring is disposed between said first and second mounts, said shaft is disposed within said spring, said spring having a first end contacting said mounting plate and a second end contacting said release.

6. A switch inhibitor according to claim 1 wherein said platform further comprises:

a mounting plate for supporting said spring;

a member for transferring a moment from said mounting plate to the cover plate; and an aperture disposed on a mounting location that corresponds to a cover plate aperture.

7. A switch inhibitor according to claim 6 wherein said platform further comprises:

a first mount extending outward from the cover plate;

a second mount extending outward from the cover plate; and a shaft disposed between said first mount and said second mount.

8. A switch inhibitor according to claim 7 wherein said spring is disposed between said first and second mounts, said shaft is disposed within said spring, said spring having a first end contacting said platform and a second end contacting said release.

9. A switch inhibitor according to claim 7 wherein said spring is disposed between said first and second mounts, said shaft is disposed within said spring, said spring connected to said release and in contact with a surface approximately parallel to the cover plate.

10. A switch cover according to claim 1 wherein said movable flange further includes a gap for allowing the switch-toggle to be positioned in a third position between said first position and said second position.

11. A switch cover according to claim 1 further comprising a retractable device for restraining said spring from being released to said passive position.

12. A switch cover plate for connecting to a conventional wall-mounted electrical switch having a switch-toggle rotatably positionable to one of a current-on and a current-off position across a switch arc volume in a toggle movement, said switch cover comprising comprising:

a panel contoured to restrict access to electrical wiring in the wall-mounted electrical switch when connected thereto, having a toggle aperture through which the switch-toggle can extend;

a movable flange for impeding the toggle movement of the switch-toggle, wherein said movable flange can travel between a passive position and a forced position;

a spring for holding said movable flange in said passive position, said spring connected with said panel and with said movable flange so that said spring and said movable flange can move coöperatively while said panel is stationary; and a release for controllably overcoming said spring, wherein said movable flange is moved to said forced position if a force is applied to said release allowing the switch-toggle to be positioned from a first position to a second position, said first position and second position being one of either the current-on position or the current-off position, wherein said first position differs from said second position.

13. A switch cover plate according to claim 12 wherein said panel further includes:

a mounting plate; and a plurality of fasteners connecting said mounting plate to the cover plate.

14. A switch cover plate according to claim 13 wherein said plurality of fasteners are rivets.

15. A switch cover plate according to claim 13 wherein said mounting plate further comprises:

a first mount extending outward from the panel;

a second mount extending outward from the panel; and a shaft disposed between said first mount and said second mount.

16. A switch cover plate according to claim 15 wherein said spring is disposed between said first and second mounts, said shaft is disposed within said spring, said spring having a first end contacting said mounting plate and a second end contacting said release.

17. A switch cover for releasably restricting a switch-toggle, said switch cover removably attached to a conventional wall-mounted electrical switch having said switch-toggle rotatably positionable to one of a current-on switch position and a current-off switch position across a switch arc volume in a toggle movement, said switch cover comprising:

an attachment for removably securing the switch cover to the electrical switch;

a movable flange for impeding the toggle movement of the switch-toggle, wherein said movable flange can travel between a passive position and a forced position;

a spring for holding said movable flange in said passive position, said spring connected with said movable flange so that said spring and said movable flange can move coöperatively; and a release for controllably retracting said spring, wherein said movable flange is moved to said forced position if a force is applied to said release allowing the switch-toggle to be positioned from a first position to a second position, said first position and second position being one of either the current-on position or the current-off position, wherein said first position differs from said second position, wherein said release further includes a rotatable handle disposed outward from the electrical switch in said passive position and disposed to approximately adjacent the switch-toggle in said forced position.

18. A switch cover according to claim 17 wherein said attachment further comprises:

a cover housing.

19. A method for a switch inhibitor to releasably restrict a switch-toggle, said switch cover being connected to a conventional wall-mounted electrical switch having said switch-toggle rotatably positionable to one of a current-on switch position and a current-off switch position across a switch arc volume in a toggle movement, said method comprising:

securing the switch inhibitor to the electrical switch by an attachment mechanism;

impeding movement of the switch-toggle by a movable flange, wherein said movable flange can travel between a passive position and a forced position;

holding said movable flange in said passive position by a spring, said spring movably connected with said movable flange; and controllably overcoming said spring by a release mechanism, wherein said movable flange is moved to said forced position allowing the switch-toggle to be positioned from a first position to a second position, said first position and second position being one of either the current-on position or the current-off position, wherein said first position differs from said second position.

20. A method according to claim 19 further comprising:

releasably restraining said spring from being released to said passive position.

* * * * *